United States Patent [19]

Nakamura

[11] 4,373,243

[45] Feb. 15, 1983

[54] METHOD OF FORMING REINFORCED PLATE-TYPE HEAT EXCHANGER

[75] Inventor: Masakazu Nakamura, Takarazuka, Japan

[73] Assignee: Sumitomo Precision Products Co. Ltd., Amagasaki, Japan

[21] Appl. No.: 132,185

[22] Filed: Mar. 20, 1980

Related U.S. Application Data

[63] Continuation of Ser. No. 895,026, Apr. 10, 1978, abandoned.

[30] Foreign Application Priority Data

Apr. 23, 1977 [JP] Japan ..... 52-52093[U]

[51] Int. Cl.[3] ..... B23P 15/26; B23K 31/02

[52] U.S. Cl. ..... 29/157.3 D; 228/254; 228/183

[58] Field of Search ..... 165/166; 228/183, 254; 29/157.3 R, 157.3 D; 113/118 V, 118 R, 1 C, 1 M, 116 UT, 116 W, 118 D

[56] References Cited

U.S. PATENT DOCUMENTS

| | | | |
|---|---|---|---|
| 2,985,434 | 5/1961 | Boring et al. | 165/166 |
| 3,341,925 | 9/1967 | Gerstung | 228/183 X |
| 3,375,570 | 4/1968 | Dubusker et al. | 228/254 |
| 4,053,969 | 10/1977 | Bayard | 228/183 |

*Primary Examiner*—Francis S. Husar
*Assistant Examiner*—V. K. Rising
*Attorney, Agent, or Firm*—Watson, Cole, Grindle & Watson

[57] ABSTRACT

In brazed aluminum heat exchangers of plate type composed of piled heat exchanger units each comprising corrugated fin within the space defined by two sheets and side bars arranged at both ends of the plates, an improved heat exchanger comprising placing a thick bare member on the brazing sheet of the outer plate materials of the outermost units as a reinforcing member and brazing integrally by fluxless brazing procedure, thereby eliminating any special member.

1 Claim, 5 Drawing Figures

METHOD OF FORMING REINFORCED PLATE-TYPE HEAT EXCHANGER

This application is continuation application of application Ser. No. 895,026, filed Apr. 10, 1978 now abandoned.

BACKGROUND OF THE INVENTION

1. Field of Invention

This invention relates to aluminum plate-type heat exchangers of plate type, and more particularly to improved reinforcing means positioned at the outermost ends of such heat exchanger.

2. Description of the Prior Art

Conventional aluminum plate-type heat exchangers are composed a number of combined exchanger sub-units which each comprise side bars which are arranged between opposite ends of parallel and a corrugated fin located in the area between the side bars and the spaced apart plates.

Such heat exchanger sub-units are conventionally joined together by a furnace brazing or dip brazing procedure using flux in order to prevent the aluminum members from oxidizing. With such procedures, however, it is quite difficult and expensive to make and maintain the attached condition of the reinforcing members which must be used at the exposed ends of the heat exchanger, e.g., due to the fact that the layer of brazing material which must be used to join the thick outermost reinforcing member with the adjacent structure is quite difficult to clad onto the thick reinforcing member.

On the other hand, a fluxless brazing process for aluminum has recently come into practical use. The fluxless brazing process has been proposed to eliminate the drawbacks caused by the use of flux e.g., the drawbacks of expensive cost of and extensive labor needed in washing the brazed aluminum members so as to reduce the strong corrosiveness of the flux to the aluminum. However, even when a heat exchanger is fabricated by using a fluxless brazing process, the reinforcing means at the outermost portion must be composed similarly to the situation when using a conventional flux brazing process, i.e., brazed by using a brazing layer composed of a separate brazing foil or a brazing material cladded on one surface of the brazing means. Thus, the multiplicity and complexity of member manipulations are not improved when using such a fabrication process.

A principal object of the present invention is to provide a plate-type heat exchanger which eliminates the above-mentioned disadvantages and which can be fabricated conveniently and inexpensively.

SUMMARY OF THE INVENTION

According to the present invention, the brazing layer needed on the outermost reinforcing members of the plate-type heat exchanger is brazed thereto by a fluxless brazing process, such as a vacuum brazing process, such that the brazing layer is secured thereto in a much more uniform fashion than with prior art systems wherein the brazing layer is brazed to the reinforcing members by a flux brazing process.

Further features and advantages of the invention will become apparent from a review of the accompanying drawings taken with the following discussion.

DETAILED DESCRIPTION OF PREFERRED EMBODIMENTS

Figure 1:
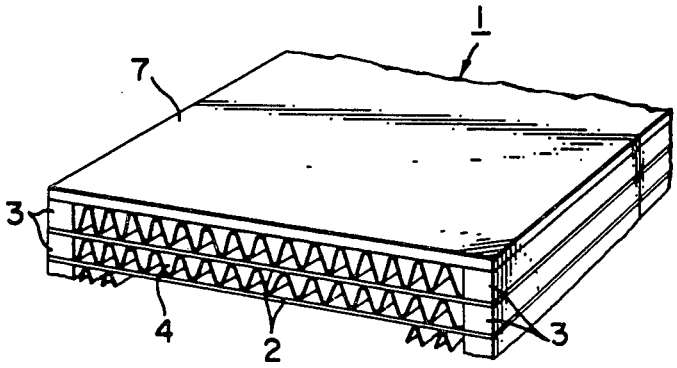
FIG. 1 (PRIOR ART)
FIG. 1 shows a perspective view of a section of a plate type prior art heat exchanger.
Figure 2:
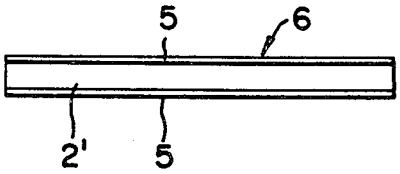
FIG. 2 (PRIOR ART)
FIG. 2 shows a schematic side view of a prior art brazing sheet.

As shown in FIG. 1, conventional plate-type heat exchangers are made up of a multiplicity of combined sub-units which each include aluminum plates 2 which are connected in parallel, spaced apart fashion by side bars 3, and in the area between the plates 2 and side bars 3 is located a corrugated fin means 4. All of the members of the sub-unit are conventionally joined together by a flux brazing process, e.g., a furnace brazing or a dip brazing procedure, in order to prevent the aluminum members from oxidizing. Thus, as shown in FIG. 2, the plates 2 in FIG. 1 are composed of aluminum plates 2 which have clad on either side thereof a brazing material 5, i.e., so as to form a "brazing sheet" 6, and after the side bars 3 and corrugated fins 4 are positioned therebetween, the members are flux brazed together to form a heat exchanger (the fluid passageways being formed due to the crests and bottoms of each corrugated fin being brazed to an adjacent brazing sheet).

Figure 3:
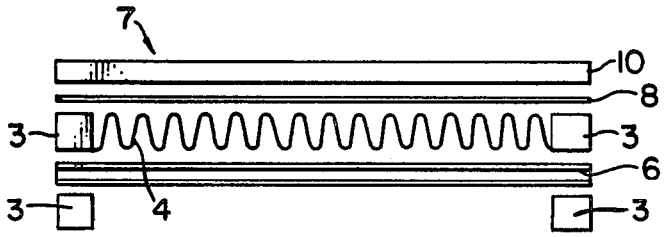
FIG. 3 (PRIOR ART)
FIG. 3 shows a schematic longitudinal sectional view of a prior art heat exchanger showing the members in spaced apart relation before assembly into a heat exchanger.
Figure 4:
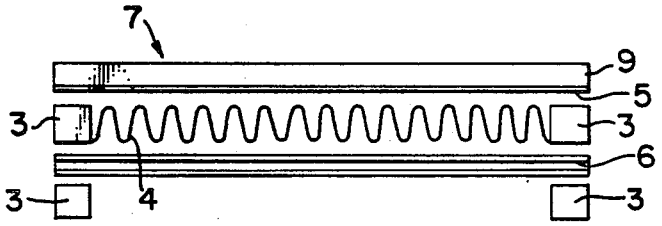
FIG. 4 (PRIOR ART)
FIG. 4 shows another longitudinal sectional view of the heat exchanger of FIG. 3 at a subsequent point in the assembly process.

On the other hand, on the outermost portions of the heat exchanger a bare member 10, which has a thickness substantially greater than that of a brazing sheet, is used as a reinforcing means 7 (see FIG. 3). A brazing foil 8 is usually employed for joining the bare member 10 with both the side bars 3 and the crests (or bottoms as the case may be) of the corrugated fins 4. As shown in FIG. 4, an alternate method may be to employ a thick bare member 9 which is already clad with a brazing material 5 on one surface. However, it is inherently difficult to clad the brazing material to the thick bare member 9 and thus forming heat exchangers with this construction requires much labor and expense.

Figure 5:
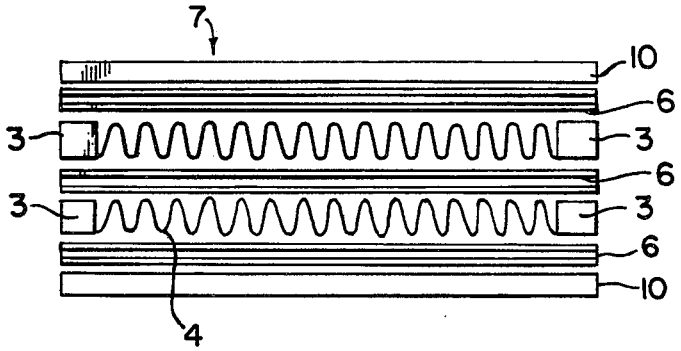
FIG. 5 shows longitudinal sectional view of a heat exchanger according to the present invention prior to assembly.

According to the present invention, however, and as shown in FIG. 5, the outermost sub-units, and thus the entire heat exchanger, can be reinforced by using a bare member 10 which has no cladding of any type thereon and placing between it and the side bars 3 and corrugated fins 4 in a brazing sheet 6 (such as that shown in FIG. 2), and then joining the members via a fluxless brazing process.

It should be noted that when a conventional flux brazing process is employed, the brazing material between the brazing sheet 6 and the bare member 10 comes into contact substantially with the flux only at the respective edges of the above-mentioned members so that the flux never penetrate far into the brazing material. Thus a complete and uniform brazing between the brazing sheet 6 and the bare member 10 is difficult, if not impossible to achieve. On the other hand, by using a fluxless brazing process, unlike the conventional flux brazing process in which, as noted above, the brazing cannot be achieved unless the flux penetrates to the point of brazing, face contact brazing can be fully and securely achieved such that the brazing plate 6 and the bare member 10 can be rigidly and uniformly joined to each other.

Thus, the plate-type heat exchanger according to the present invention is formed by first interposing a common brazing sheet between the outermost reinforcing member and the members to be joined to the reinforcing member, and then brazing the members together using a fluxless brazing process. In other words, according to the present invention the reinforcing member 7 need not employ as thick and expensive a bare member 10 and which necessarily has one surface clad with a brazing material or a brazing foil as is required in a conventional process, and the heat exchanger can instead be fabricated using only members which are usually employed in the manufacture of a plate-type heat exchanger. Therefore, it can easily be fabricated and the material management can be simplified so that the heat exchanger of the present invention is provided with a high industrial marketability.

What is claimed is:

1. A method for fabricating an aluminum heat exchanger using a fluxless brazing process which consists of:

(a) positioning a first bare aluminum reinforcing member such that one side surface thereof is exposed, said first reinforcing member having a rectangular shape of certain length and width dimensions, (b) positioning a brazing sheet in contact with the exposed surface of said first reinforcing member, said brazing sheet having a rectangular shape of the same length and width dimensions as said first reinforcing member and consisting of an aluminum plate with brazing material clad to opposite sides thereof, (c) positioning two identical side bars in contact with said brazing sheet so as to be positioned in parallel along opposite sides of said brazing sheet, (d) positioning a corrugated aluminum fin means between said side bars and so as to be in contact with the portion of said brazing sheet therebetween, (e) positioning another said brazing sheet in contact with both said side bars and said corrugated fin means, said steps (b), (c), (d) and (e) acting to form a single heat exchanger sub-unit, (f) repeating steps (b), (c), (d) and (e) to form a multiplicity of additional heat exchanger sub-units against one another, (g) positioning a second bare aluminum reinforcing member against the final brazing sheet, said second reinforcing member having a rectangular shape of the length and width dimensions as said first reinforcing member, and (h) evacuating the space around said elements and heating said elements so as to braze together all the elements via a fluxless brazing technique and form the aluminum heat exchanger.

* * * * *